US010612173B2

(12) United States Patent
Groelz et al.

(10) Patent No.: US 10,612,173 B2
(45) Date of Patent: Apr. 7, 2020

(54) HOPPING FOOT FOR A MANEUVERABLE QUILTING MACHINE

(71) Applicant: HANDI QUILTER, INC., North Salt Lake, UT (US)

(72) Inventors: Brenda Lee Groelz, Syracuse, UT (US); Sarah Ann Watts, Sandy, UT (US); Vicki Crook Hoth, Centerville, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 77 days.

(21) Appl. No.: 15/981,484

(22) Filed: May 16, 2018

(65) Prior Publication Data

US 2019/0352824 A1 Nov. 21, 2019

(51) Int. Cl.

| | |
|---|---|
| ***D05B 29/06*** | (2006.01) |
| ***D05B 29/08*** | (2006.01) |
| ***D05B 11/00*** | (2006.01) |

(52) U.S. Cl.

CPC ..... *D05B 29/08* (2013.01); *D05B 11/00* (2013.01); *D05B 29/06* (2013.01); *D05D 2209/02* (2013.01)

(58) Field of Classification Search

CPC ..... D05B 29/12; D05B 29/06

See application file for complete search history.

(56) References Cited

U.S. PATENT DOCUMENTS

| | | | | | |
|---|---|---|---|---|---|
| 3,259,090 | A * | 7/1966 | Howell | D05B 3/18 | 112/240 |
| 3,334,605 | A * | 8/1967 | Boser | D05B 29/08 | 112/235 |
| 3,342,151 | A * | 9/1967 | Howell | D05B 29/06 | 112/235 |
| 3,511,201 | A * | 5/1970 | Howell | D05B 3/18 | 112/240 |
| 4,069,780 | A * | 1/1978 | Minami | D05B 35/064 | 112/150 |
| 5,676,075 | A * | 10/1997 | Chen | D05B 29/12 | 112/240 |
| 2003/0209179 | A1* | 11/2003 | Scordos | D05B 29/06 | 112/235 |

* cited by examiner

*Primary Examiner* — Tajash D Patel
(74) *Attorney, Agent, or Firm* — Maschoff Brennan

(57) ABSTRACT

Hopping foot for a maneuverable quilting machine. In some embodiments, an example hopping foot may include a presser bar shaft configured to couple to a presser bar and a base attached to the presser bar shaft. The base may define a left straight edge, a right straight edge, a front straight edge, a bottom surface configured to hop onto and off of a fabric, and a needle opening configured to allow a needle to reciprocate into and out of the fabric through the needle opening.

20 Claims, 9 Drawing Sheets

HOPPING FOOT FOR A MANEUVERABLE QUILTING MACHINE

BACKGROUND

Sewing machines generally function by reciprocating a threaded needle into and out of one or more layers of fabric to form a row of stitches in the fabric. While some sewing machines are operated in a stationary fashion while the fabric is repositioned underneath the needle, other sewing machines, such as quilting machines, are operated in a maneuverable fashion by repositioning the needle while the fabric remains stationary. When operated in this maneuverable fashion, the fabric is typically mounted on a fabric frame.

One difficulty encountered with maneuverable quilting machines and fabric frames is accurately sewing a row of stitches along a predetermined path on the fabric during operation of the quilting machine. Where the quilting machine is able to be maneuvered in any direction on the fabric frame, it can be difficult for a user to accurately guide the needle of the maneuverable quilting machine along a predetermined path where the user desires to form a row of stitches without straying from the path.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a hopping foot for a maneuverable quilting machine. In some embodiments, an example hopping foot may include a presser bar shaft configured to couple to a presser bar and a base attached to the presser bar shaft. The base may define a left straight edge, a right straight edge, a front straight edge, a bottom surface configured to hop onto and off of a fabric, and a needle opening configured to allow a needle to reciprocate into and out of the fabric through the needle opening.

In some embodiments, the front straight edge may be perpendicular to the left straight edge and the right straight edge. In these embodiments, the base further may define a rear straight edge and the rear straight edge may be perpendicular to the left straight edge and the right straight edge. In these embodiments, the left straight edge may be spaced apart from the right straight edge by about 0.50 inches and the front straight edge may be spaced apart from the rear straight edge by about 0.50 inches. Alternatively, in these embodiments, the left straight edge may be spaced apart from the right straight edge by about 1.0 inches and the front straight edge may be spaced apart from the rear straight edge by about 1.0 inches.

In some embodiments, the presser bar shaft may be configured to couple to the presser bar via a portion of the presser bar being inserted into an opening defined in the presser bar shaft.

In some embodiments, at least a portion of the base may be formed from a transparent material. In these embodiments, the presser bar shaft and the base may be formed from a transparent material.

Further, in some embodiments, the maneuverable quilting machine may be a long-arm quilting machine.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

Where a quilting machine is able to be maneuvered in any direction on a fabric frame, it can be difficult for a user to accurately guide a hopping foot and needle of the quilting machine along a predetermined path where the user desires to form a row of stitches, such as along a seam, or such as along an edge of the quilt (which is a process known as binding), without straying from the path. To help guide the hopping foot (which conventionally has a circular configuration with only round edges), a user may position a ruler against a quilt-top fabric along a predetermined path where the user desires to form the row of stitches. The ruler may then help the user avoid the hopping foot from straying from the predetermined path. However, using a ruler in this manner can be problematic because it can be difficult for a user to accurately guide a hopping foot along a straight edge of the ruler due to one or more edges of the hopping foot being round, such as where the hopping foot has a circular configuration. Further, using a ruler in this manner can also be problematic if the ruler gets jammed underneath the hopping foot of the quilting machine, which can at least cause the quilting machine to miss one or more stitches, and at worst can damage the needle and/or the hopping foot, or other related mechanisms of the quilting machine.

The embodiments disclosed herein may provide various benefits. In particular, the embodiments disclosed herein may, for example, provide a hopping foot that enables a user to more accurately use a ruler to guide a hopping foot along a straight path within a fabric frame, or to avoid using a ruler altogether, due to the hopping foot having one or more straight edges. Because using a ruler requires the user to have one hand on the ruler, avoiding the use of a ruler may allow the user to have both hands on the quilting machine (instead of one hand on the ruler and just one hand on the quilting machine) for better control of the quilting machine. Further, the embodiments disclosed herein may enable a user to sew together pieces of a quilt-top fabric (which is a process known as piecing) using a quilting machine mounted in a fabric frame instead of on a separate machine.

Further, the embodiments disclosed herein may enable a user to have a consistent seam allowance while stitching along a straight path.

Figure 1A:
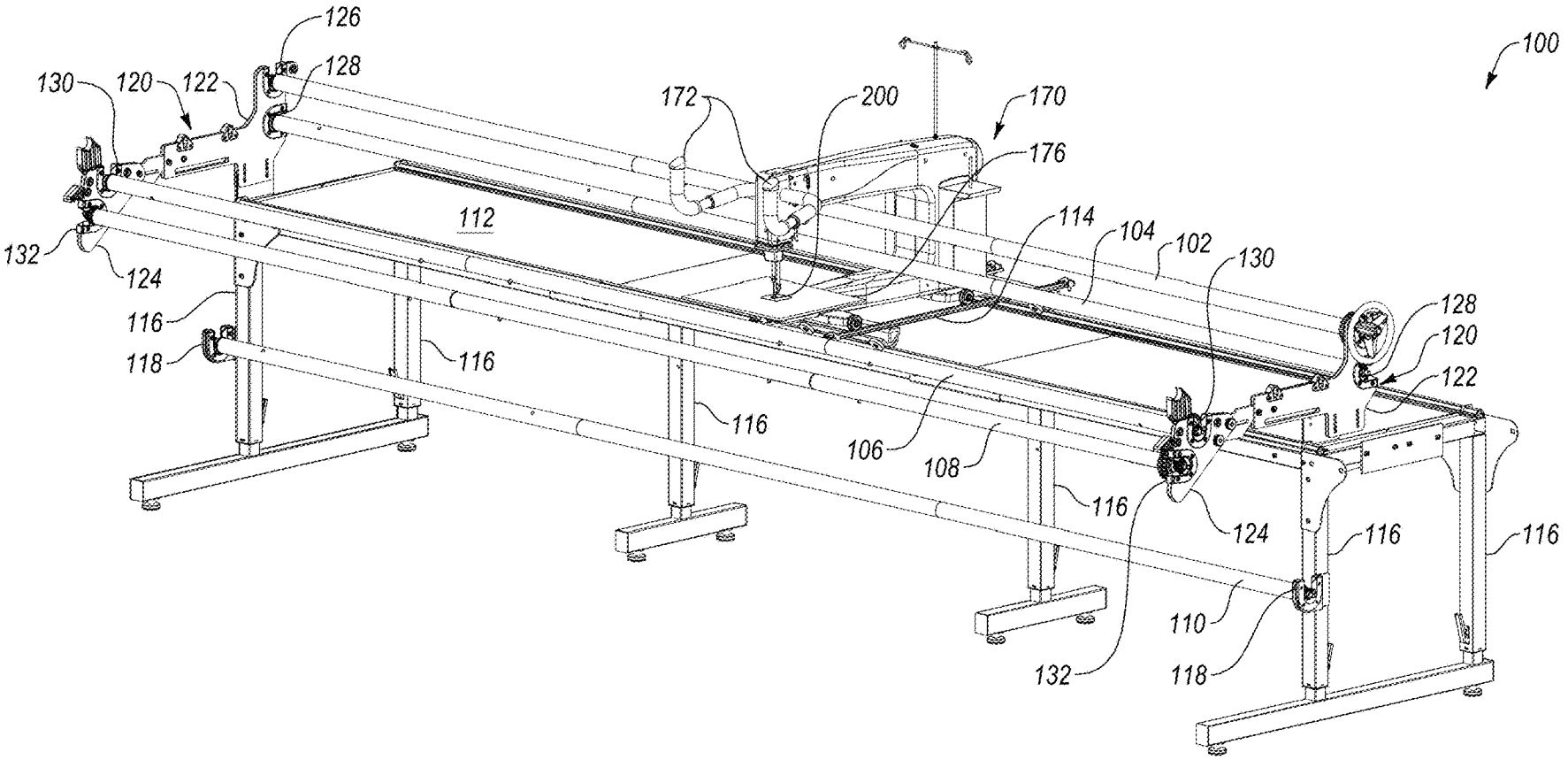
FIG. 1A is a front top perspective view of an example quilting machine having an example hopping foot and mounted on an example fabric frame.
Figure 1B:
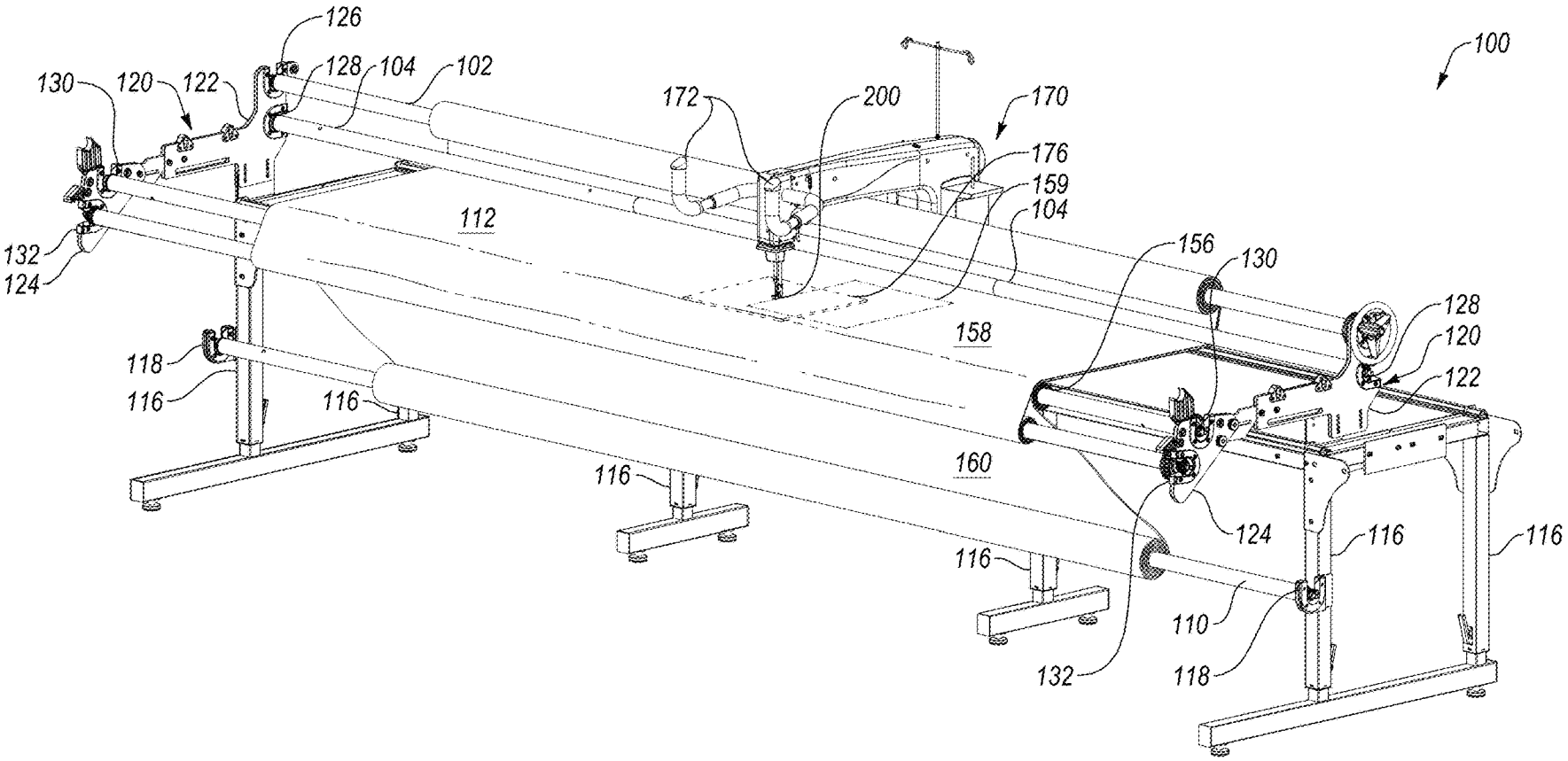
FIG. 1B is a front top perspective view of the example quilting machine having the example hopping foot and mounted on the example fabric frame of FIG. 1A with fabric spooled thereon.
Figure 1C:
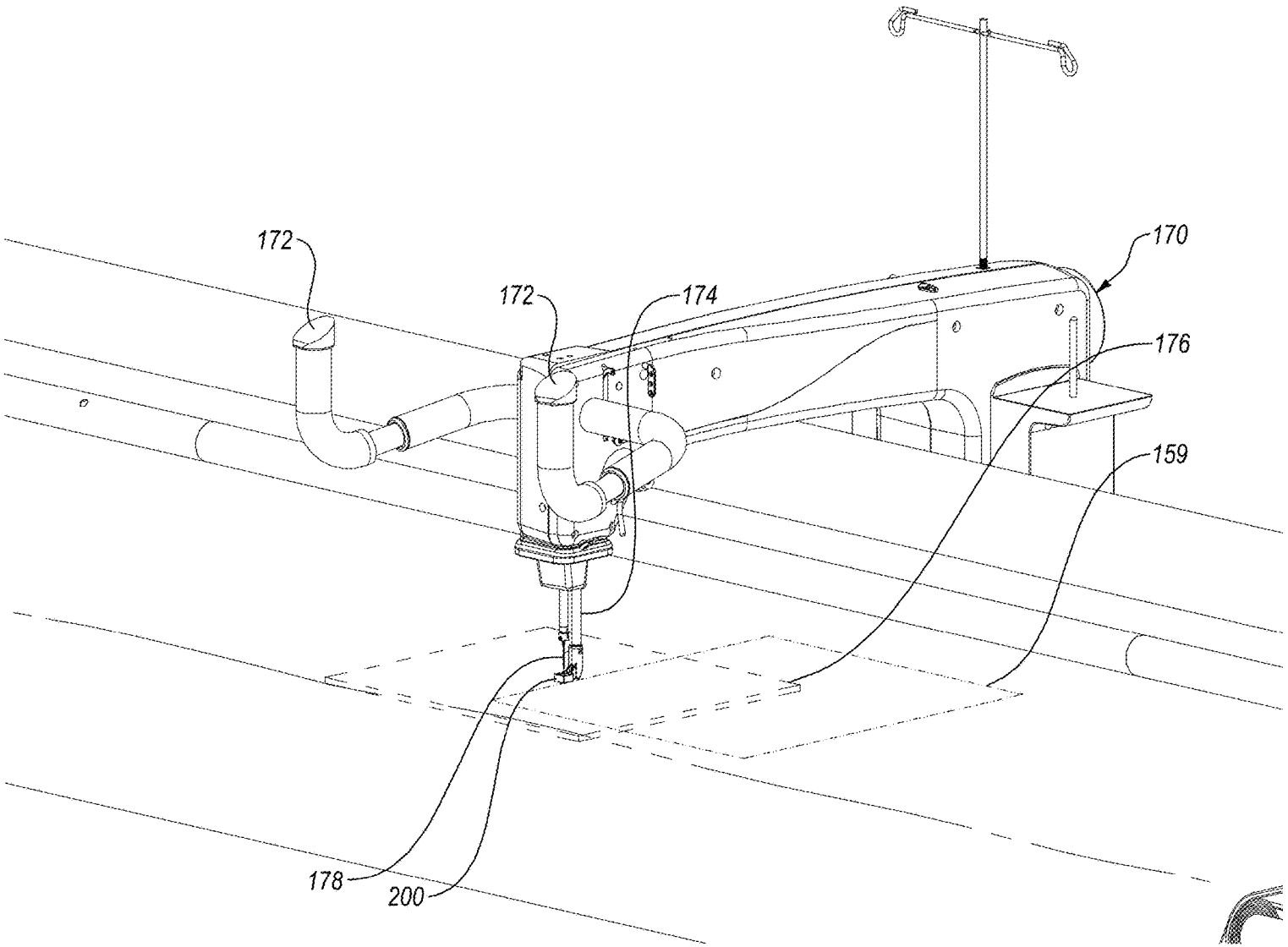
FIG. 1C is an enlarged view of a portion of FIG. 1B.

Turning to the figures, FIG. 1A is a front top perspective view of an example quilting machine 170 having an example hopping foot 200 and mounted on an example fabric frame 100, FIG. 1B is a front top perspective view of the example quilting machine 170 having the example hopping foot 200 and mounted on the example fabric frame 100 of FIG. 1A with fabric spooled thereon, and FIG. 1C is an enlarged view of a portion of FIG. 1B.

The maneuverable quilting machine 170 of FIGS. 1A-1C is specialized for quilting and is known as a long-arm quilting machine. A long-arm quilting machine may be distinguished from other types of quilting machines because of the "long-arm" configuration of the machine. A long-arm quilting machine may include one or more of handlebars 172, a presser bar 174, a ruler base 176, and a needle 178, among other components. Quilting using the quilting machine 170 typically involves stitching together multiple layers of fabric to form a quilt. A quilt typically includes a layer of batting fabric sandwiched in between an upper quilt-top fabric and a lower backing fabric. However, although the example maneuverable quilting machine 170 of FIGS. 1A-1C is a long-arm quilting machine, it is understood that the maneuverable quilting machine 170 is only one of countless maneuverable quilting machines in which the example hopping feet disclosed herein may be employed. The scope of the example hopping feet disclosed herein is therefore not intended to be limited to employment with any particular quilting machine.

As disclosed in FIG. 1A, the fabric frame 100 may include a take-up pole 102, an idler pole 104, a backing pole 106, a quilt-top pole 108, a batting pole 110, and side rails 120. The fabric frame 100 may further include a tabletop 112 upon which a carriage 114 is mounted, as well as legs 116 supporting the side rails 120 and the tabletop 112. It is understood that the fabric frame 100 is only one of countless fabric frames with which the example hopping feet disclosed herein may be employed. The scope of the example hopping feet disclosed herein is therefore not intended to be limited to employment with any particular fabric frame.

In some embodiments, the side rails 120 may include stationary portions 122 and reconfigurable portions 124. The stationary portions 122 may include take-up pole attachment locations 126 and idler pole attachment locations 128. The reconfigurable portions 124 may include backing pole attachment locations 130 and quilt-top pole attachment locations 132. Further, the legs 116 may include batting pole attachment locations 118. In the first configuration disclosed in FIGS. 1A-1C, the backing pole attachment locations 130 may be higher than the quilt-top pole attachment locations 132. In a second configuration (not shown), the backing pole attachment locations 130 may be lower than the quilt-top pole attachment locations 132.

Each of the backing pole 106, the quilt-top pole 108, and the batting pole 110 may be configured to have a layer of fabric spooled thereon, and the maneuverable quilting machine 170 may be employed to sew these three layers of fabric together into a quilt that is then spooled on the take-up pole 102. Further, any of the backing pole attachment locations 130, the quilt-top pole attachment locations 132, the batting pole attachment locations 118, and the take-up pole attachment locations 126 may include ratchets configured to apply tension to the fabric spooled on the poles.

For example, while in the first configuration disclosed in FIGS. 1B and 1C, the backing pole 106 may be configured to have backing fabric 156 spooled thereon such that the backing fabric 156 flows from the front of the backing pole 106, over the top of the backing pole 106, under the hopping foot 200 of the maneuverable quilting machine 170, and under the bottom of the idler pole 104. At the same time, the quilt-top pole 108 may be configured to have quilt-top fabric 158 spooled thereon such that the quilt-top fabric 158 flows from the front of the quilt-top pole 108, over the top of the quilt-top pole 108, over the top of the backing pole 106, under the hopping foot 200 of the maneuverable quilting machine 170, and under the bottom of the idler pole 104. Also at the same time, the batting pole 110 may be configured to have batting fabric 160 spooled thereon such that the batting fabric 160 flows from the batting pole 110, between the quilt-top pole 108 and the backing pole 106 (to be sandwiched between the quilt-top fabric 158 and the backing fabric 156), over the top of the backing pole 106, under the hopping foot 200 of the maneuverable quilting machine 170, and under the bottom of the idler pole 104.

In some embodiments, while in the first configuration disclosed in FIGS. 1B and 1C, the top of the backing pole 106 and the bottom of the idler pole 104 may form a plane in which the maneuverable quilting machine 170 is configured to sew. It is understood that this "plane" may actually be raised above the top of the backing pole 106 by the thickness of the backing fabric 156 spooled on the backing pole 106, the thickness of a single layer of the batting fabric 160, and the thickness of a single layer of the quilt-top fabric 158.

Further, in some embodiments, while in the first configuration disclosed in FIGS. 1B and 1C, the backing pole 106 may be configured to enable a ruler (not shown) to be positioned next to the hopping foot 200 of the maneuverable quilting machine 170. A user may place the ruler against the quilt-top fabric 158 along a path, such as a path 159 defined by a quilt block of the quilt-top fabric 158, where the user desires to form rows of stitches. The edges of the quilt block that defines the path 159 may be sewn to edges of other quilt blocks, in a process known as piecing, using the example hopping feet disclosed herein. Alternatively, the path 159 may be a printed pattern that is printed on the quilt-top fabric 158, or a seam in the quilt-top fabric 158, and along which a user may desire to form rows of stitches. The ruler may then help the user avoid straying from the path 159 where the user desires to form the row of stitches. In order for the ruler to be helpful, it may need to remain positioned flat against the quilt-top fabric 158 on the fabric frame 100. The ruler base 176, which is positioned beneath the layers of fabric on the fabric frame 100, may at least partially support the ruler. The ruler base 176 may help keep the ruler from distorting the layers of fabric due to the weight of the ruler or due to the user pressing down on the ruler to keep it stationary.

Also, in some embodiments, while in the first configuration disclosed in FIGS. 1B and 1C, the ruler may further extend over the top of the backing pole 106 with the ruler positioned flat against the quilt-top fabric 158. Thus, even where the ruler is too long to fit in a working area of the fabric frame 100 without extending over the top of the backing pole 106, the backing pole 106 may still enable the user to benefit from the assistance of the ruler during operation of the maneuverable quilting machine 170, thereby assisting the user to accurately stitch along the path 159. It is understood that the ruler may have a straight edge or may have an edge that is curved or sinusoidal or any other shape, and the ruler may be positioned at any angle with respect to the backing pole 106.

Further, in some embodiments, the hopping foot 200 disclosed in FIG. 1C may enable the user to accurately stitch along the path 159 where the user desires to form a row of stitches, even without the assistance of any ruler. In particular, because the hopping foot 200 includes straight edges, the hopping foot 200 may enable the user to accurately freehand stitch (e.g., stitch without any ruler or other guide) along straight edges of the path 159 by simply visually aligning a straight edge of the hopping foot with a straight edge of the path 159. For example, right or left straight edges of the hopping foot 200 may enable the user to accurately freehand stitch along front-to-rear straight edges of the path 159, while front or rear straight edges of the hopping foot 200 may enable the user to accurately freehand stitch along right-to-left straight edges of the path 159. Also, where the front and rear straight edges of the hopping foot 200 are perpendicular to the right and left straight edges of the hopping foot 200, the hopping foot 200 may enable the user to smoothly turn the corner on the fly between accurately freehand stitching along a front-to-rear straight edge of the path 159 to accurately freehand stitching along a perpendicular right-to-left straight edge of the path 159. Further, where at least a portion of the hopping foot 200 is transparent, the hopping foot 200 may enable the user to accurately freehand stitch along the path 159 without the hopping foot 200 visually obscuring the path 159 or fabric surrounding the path 159, since the path 159 and the fabric surrounding the path 159 may be viewed by the user through the transparent portion of the hopping foot 200.

Figure 2A:
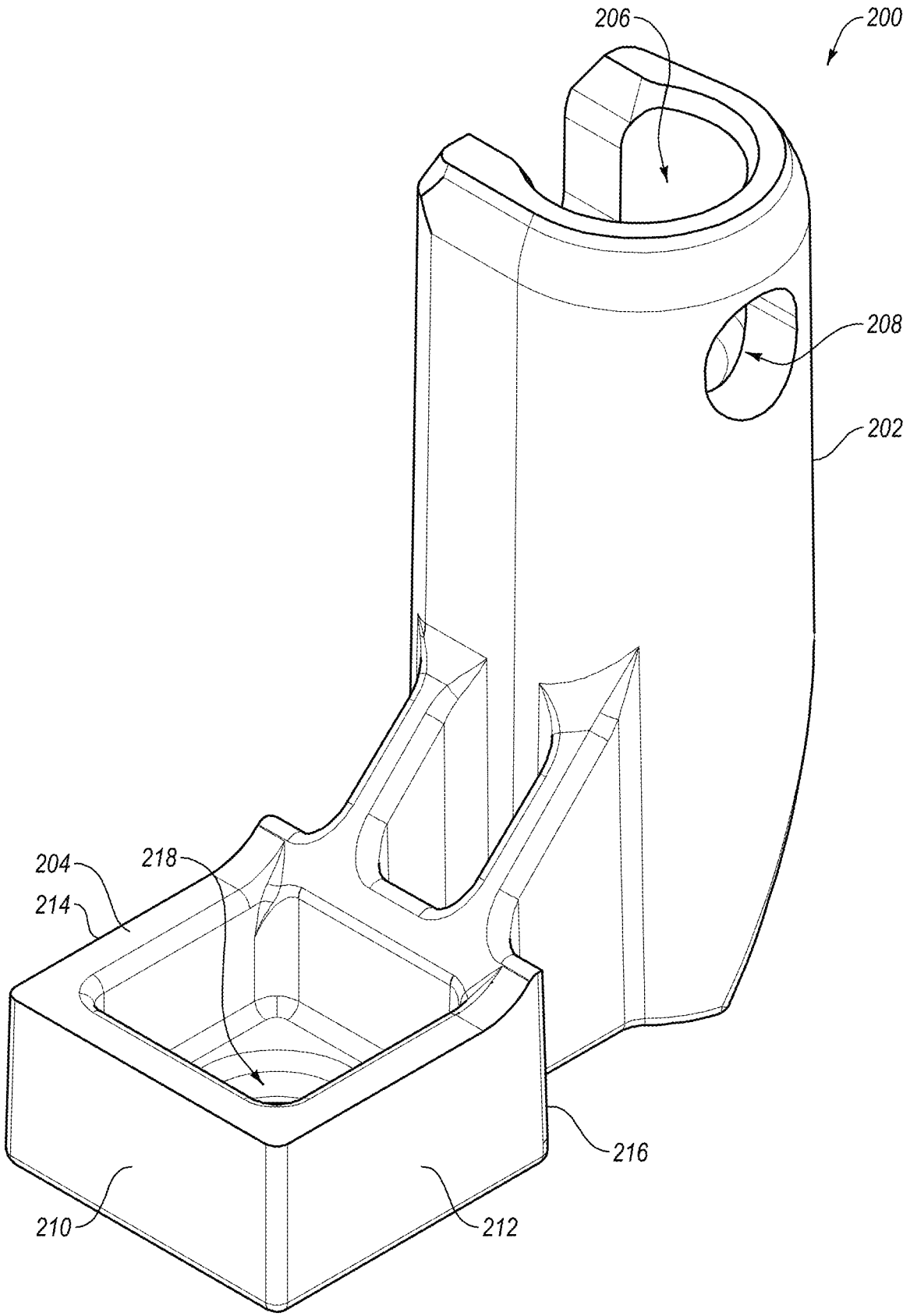
FIGS. 2A, 2B, and 2C are a front top perspective view, a top view, and a front view, respectively, of the example hopping foot of FIGS. 1A-1C.
Figure 2B:
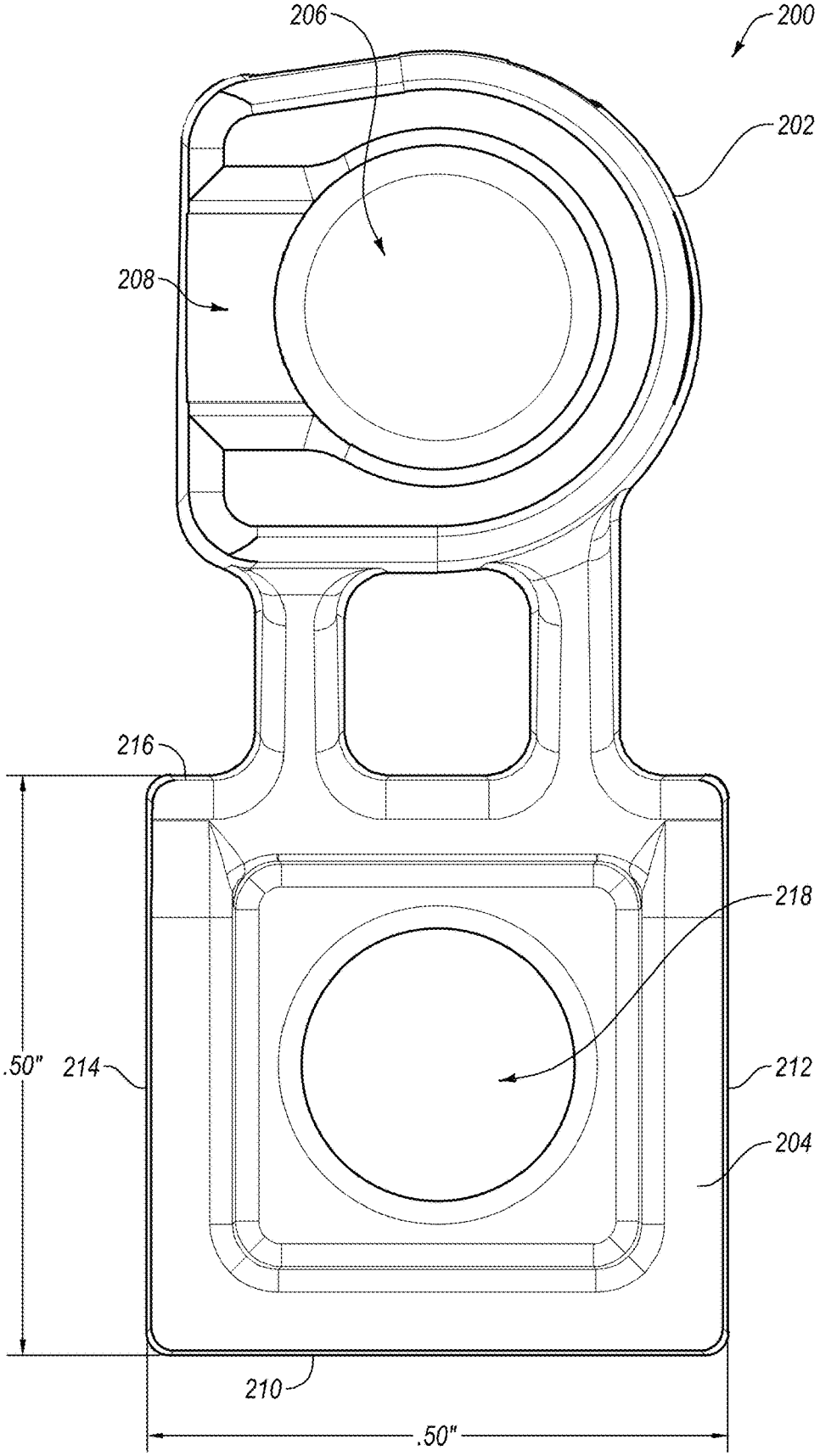
Figure 2C:
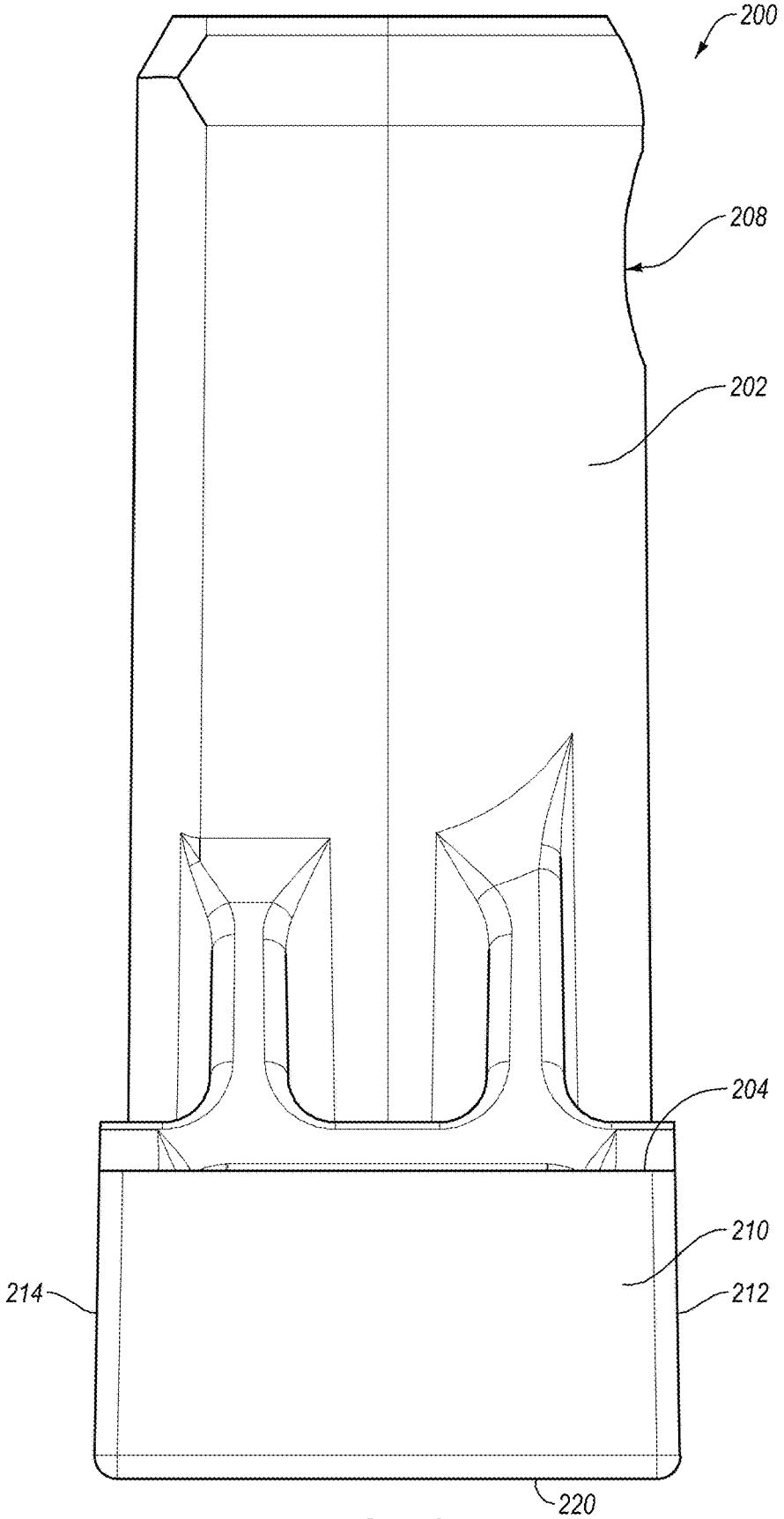

FIGS. 2A, 2B, and 2C are a front top perspective view, a top view, and a front view, respectively, of the example hopping foot 200 of FIGS. 1A-1C. As disclosed in FIGS. 2A-2C, the hopping foot 200 may include a presser bar shaft 202 and a base 204 attached to the presser bar shaft 202.

The presser bar shaft 202 may be configured to couple to a presser bar (such as the presser bar 174 of FIG. 1C). For example, the presser bar shaft 202 may be configured to couple to the presser bar 174 via a portion of the presser bar 174 being inserted into an opening 206 defined in the presser bar shaft 202. Another opening 208 defined in the presser bar shaft 202 may be configured to receive a mounting screw (such as a 2.5 mm hex mounting screw) or other fastener to secure the inserted portion of the presser bar 174 in the opening 206, such as via a similar opening in the inserted portion of the presser bar 174 through which the mounting screw is similarly inserted.

The base 204 may define a left straight edge 214, a right straight edge 212, a front straight edge 210, a rear straight edge 216 (the entire straight portion of which is obscured in the drawings), a bottom surface 220 configured to hop onto and off of a fabric (such as the quilt-top fabric 158 of FIG. 1C), and a needle opening 218 configured to allow a needle (such as the needle 178 of FIG. 1C) to reciprocate into and out of the fabric through the needle opening 218.

As disclosed in FIG. 2B, the front straight edge 210 and the rear straight edge 216 may be perpendicular to the left straight edge 214 and the right straight edge 212, resulting in a generally rectangular configuration of the straight edges of the base 204, with slightly round corners between the straight edges. Further, the left straight edge 214 may be spaced apart from the right straight edge 212 by about 0.50 inches and the front straight edge 210 may be spaced apart from the rear straight edge 216 by about 0.50 inches, resulting in a generally square configuration of the straight edges of the base 204. After installation on a quilting machine (such as the quilting machine 170 of FIG. 1C), where a needle is positioned at about the center of the needle opening 218 (i.e., such as the needle 178 of FIG. 1C positioned about half-way in between the left straight edge 214 and the right straight edge 212, or about half-way in between the front straight edge 210 and the rear straight edge 216), the base 204 of FIG. 2B may enable a row of stitches to be consistently formed in a fabric about 0.25 inches away from any of the straight edges of the base 204, otherwise known as an about 0.25 seam allowance. In some embodiments, the hopping foot 200 with the about 0.25 seam allowance may be particularly well suited for use as a seam guide for cotton quilt-top fabrics and low-loft batting.

As disclosed in FIG. 2C, the bottom surface 220 of the base 204 of the hopping foot 200 may be a flat surface in order to press fabric layers together as the bottom surface 220 hops onto and off of a fabric (such as the quilt-top fabric 158 of FIG. 1C).

Further, as disclosed in FIGS. 2A-2C, at least a portion of the hopping foot 200 may be formed from a transparent material, such as a transparent plastic material. For example, at least a portion of the base 204 may be formed from a transparent material, the entire base 204 may be formed from a transparent material, or the entire presser bar shaft 202 and the base 204 may be formed from a transparent material. In some embodiments, the hopping foot 200 may be a single integral molded component, and may therefore be formed entirely from a transparent material. Any transparent portion of the hopping foot 200 may enable a user to accurately freehand stitch along a path (such as the path 159 of FIG. 1C) without the hopping foot 200 visually obscuring the path or fabric surrounding the path, since the path and the fabric surrounding the path may be viewed by the user through the transparent portion of the hopping foot 200.

Modifications, additions, or omissions may be made to the hopping foot 200 without departing from the scope of the present disclosure. For example, in some embodiments, only some of the edges (such as the left straight edge 214, the right straight edge 212, and the front straight edge 210) of the hopping foot 200 may be straight edges, while other edges (such as the rear straight edge 216) may be edges that are curved rather than straight. Also, in some embodiments, the hopping foot 200 may be formed entirely from a non-transparent material. Further, in some embodiments, the hopping foot 200 may include one or more straight edges, but the edges may not be perpendicular to one another, resulting in a generally non-rectangular configuration for the hopping foot 200. Also, in some embodiments, the slightly round corners between the straight edges of the hopping foot 200 may instead be sharp square corners. Further, in some embodiments, the bottom surface 220 of the base 204 of the hopping foot 200 may be a curved surface rather than a flat surface.

Also, in some embodiments, the base 204 of the hopping foot 200 may be rotatably attached to the presser bar shaft 202 of the hopping foot 200, such that base 204 may be selectively rotated by a user with respect to the presser bar shaft 202, either before or after attachment of the hopping foot 200 to a presser bar. In these embodiments, this ability of the base 204 to rotate with respect to the presser bar shaft 202 may enable the user to follow a straight path that runs at an angle, rather than being a path that runs front-to-rear or left-to-right, such as where a path runs as a 45 degree angle with respect to the front-to-rear orientation of the quilting machine 170 of FIG. 1C, and the base 204 is rotated by the user by 45 degrees with respect to the presser bar shaft 202 so that the user can accurately freehand stitch along the straight 45 degree path by simply visually aligning a straight edge of the hopping foot 200 with the straight 45 degree path.

Figure 3A:
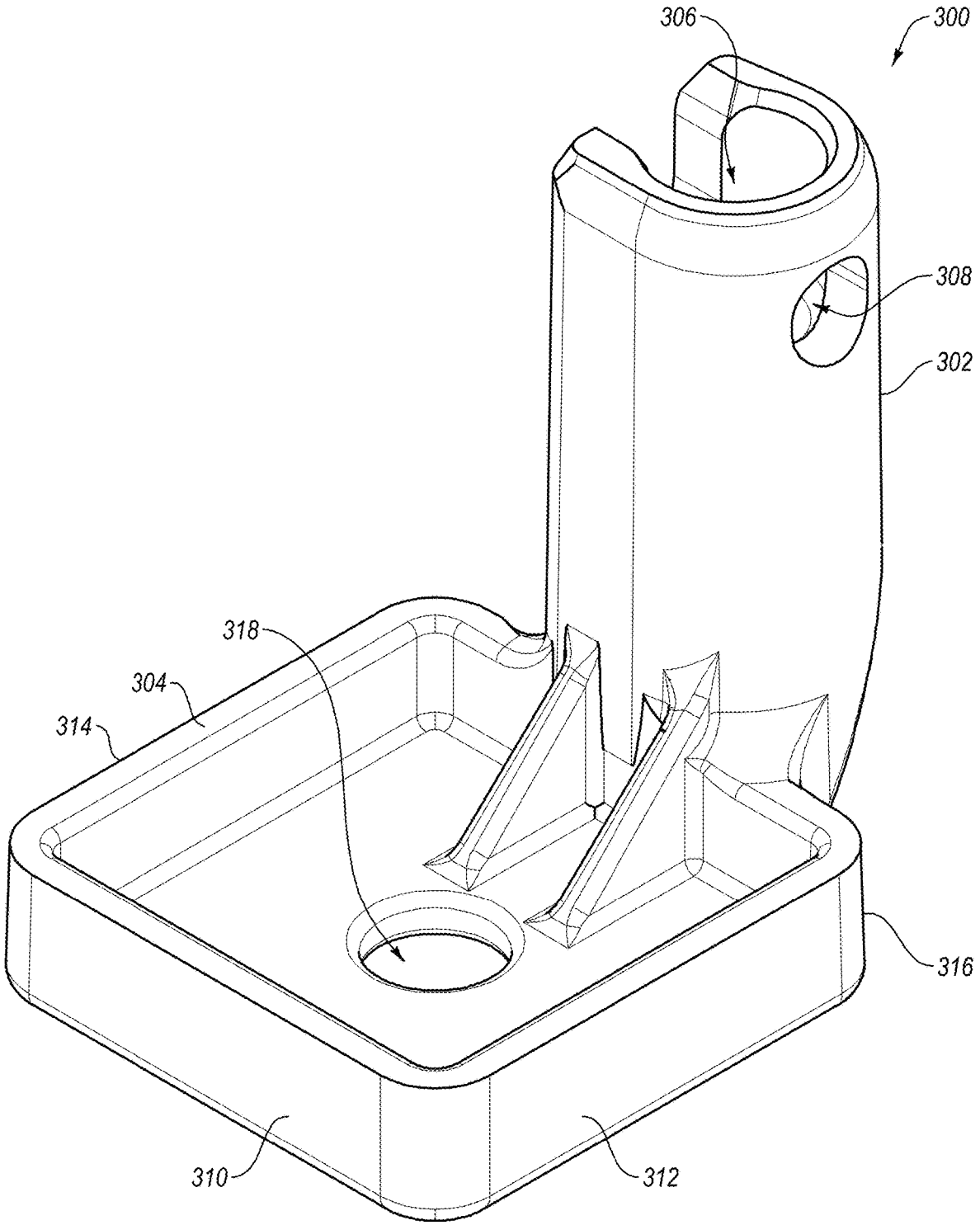
FIGS. 3A, 3B, and 3C are a front top perspective view, a top view, and a front view, respectively, of another example hopping foot.
Figure 3B:
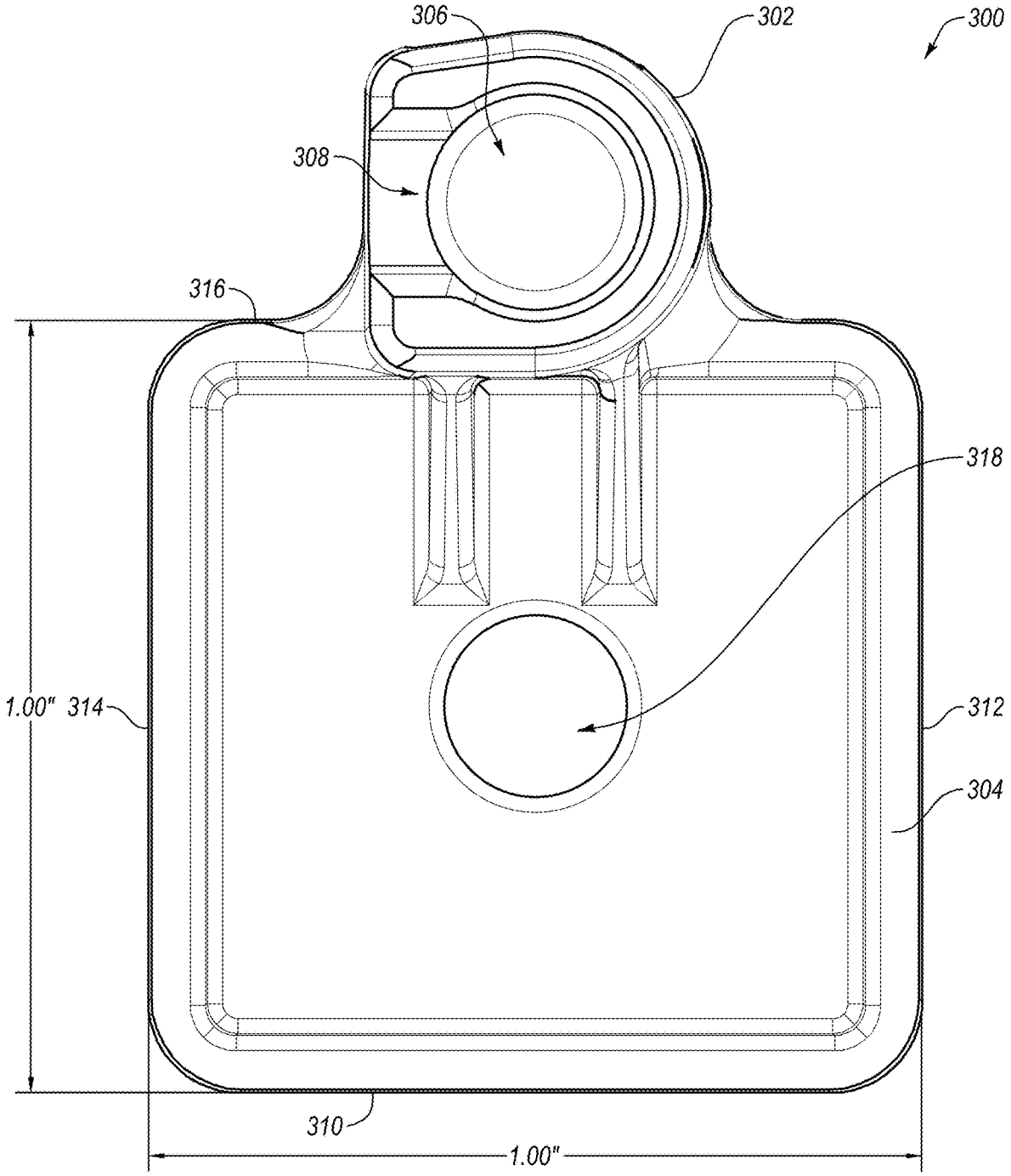
Figure 3C:
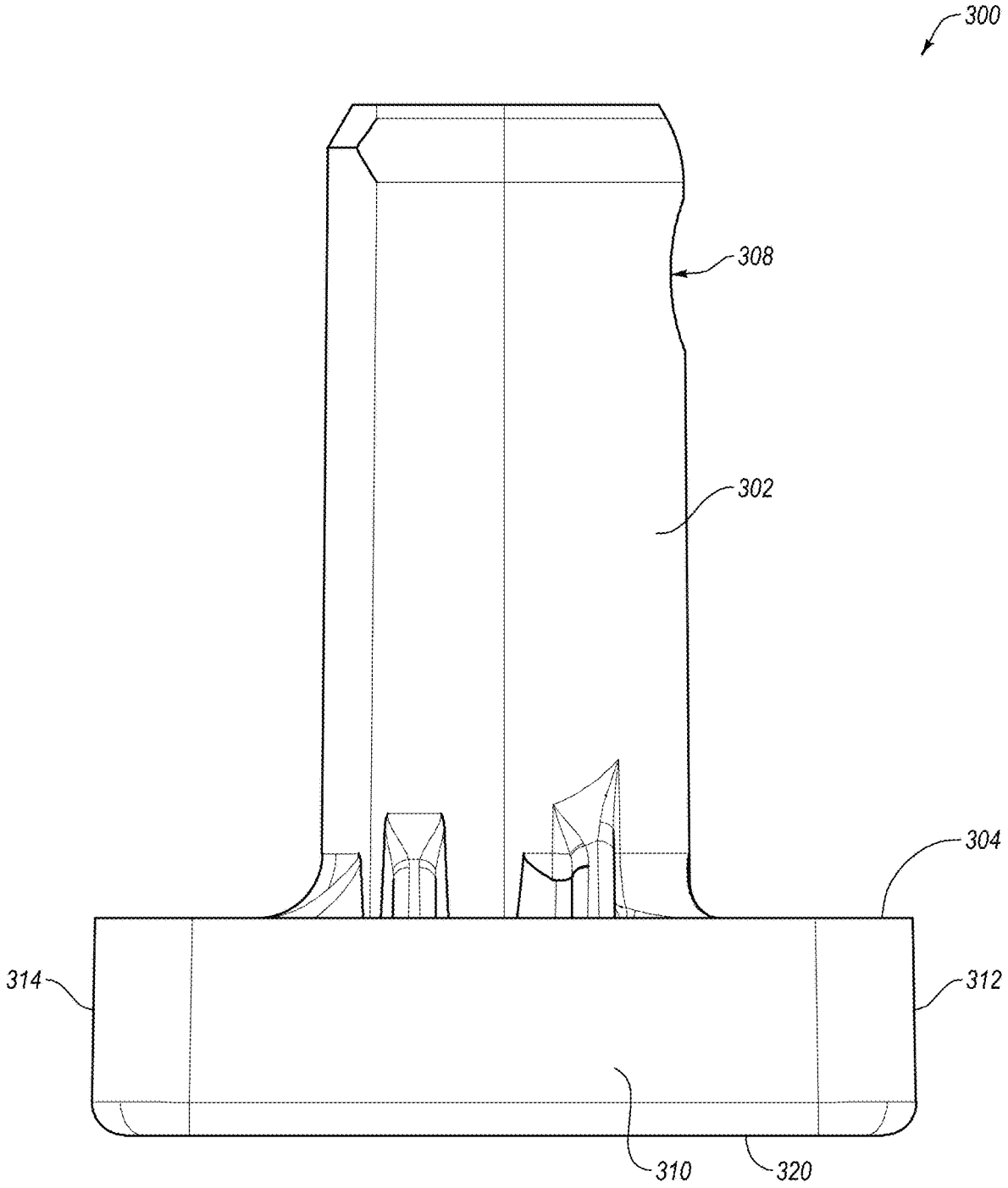

FIGS. 3A, 3B, and 3C are a front top perspective view, a top view, and a front view, respectively, of another example hopping foot 300. The hopping foot 300 is similar in many respects to the hopping foot 200, and may be interchangeable with the hopping foot 200 on the quilting machine 170 of FIG. 1C, so the discussion herein of the hopping foot 300 will be abbreviated by referencing the discussion herein of the hopping foot 200.

As disclosed in FIGS. 3A-3C, the hopping foot 300 may include a presser bar shaft 302 and a base 304 attached to the presser bar shaft 302. The presser bar shaft 302 may be configured to couple to a presser bar (such as the presser bar 174 of FIG. 1C), such as via a portion of the presser bar 174 being inserted into an opening 306 defined in the presser bar shaft 302 and a mounting screw or other fastener inserted through another opening 308 defined in the presser bar shaft 302 to secure the inserted portion of the presser bar 174 in the opening 306.

The base 304 may define a left straight edge 314, a right straight edge 312, a front straight edge 310, a rear straight edge 316, a bottom surface 320 configured to hop onto and off of a fabric (such as the quilt-top fabric 158 of FIG. 1C), and a needle opening 318 configured to allow a needle (such as the needle 178 of FIG. 1C) to reciprocate into and out of the fabric through the needle opening 318.

As disclosed in FIG. 3B, the front straight edge 310 and the rear straight edge 316 may be perpendicular to the left straight edge 314 and the right straight edge 312, resulting in a generally rectangular configuration of the straight edges of the base 304. Further, the left straight edge 314 may be spaced apart from the right straight edge 312 by about 1.00 inches and the front straight edge 310 may be spaced apart from the rear straight edge 316 by about 1.00 inches, resulting in a generally square configuration of the straight edges of the base 304. Where a needle is positioned at about the center of the needle opening 318, the base 304 of FIG. 3B may enable a row of stitches to be consistently formed in a fabric about 0.50 inches away from any of the straight edges of the base 304, otherwise known as an about 0.50 seam allowance. In some embodiments, the hopping foot 300 with the about 0.50 seam allowance may be particularly well suited for use as a seam guide for thick quilt-top fabrics and high-loft batting or multiple layers of batting.

Further, as disclosed in FIGS. 3A-3C, at least a portion of the hopping foot 300 may be formed from a transparent material, which may enable a user to accurately freehand stitch along a path (such as the path 159 of FIG. 1C) without the hopping foot 300 visually obscuring the path or fabric surrounding the path, since the path and the fabric surrounding the path may be viewed by the user through the transparent portion of the hopping foot 300.

Modifications, additions, or omissions may be made to the hopping foot 300 without departing from the scope of the present disclosure, such as modifications, additions, or omissions similar to those discussed above in connection with the hopping foot 200. Further, although the spacing between the left and right straight edges and the front and rear straight edges is about 0.50 inches in the hopping foot 200, and this spacing is about 1.00 inches in the hopping foot 300, in some embodiments this spacing may instead be about 0.75 inches or about 1.25 inches or any other desired spacing.

As used herein, the term "about" refers to a value that is within 10% of the stated value, unless otherwise specified.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A hopping foot for a maneuverable quilting machine, the hopping foot comprising:
- a base defining:
  - a left straight edge,
  - a right straight edge,
  - a front straight edge,
  - a bottom surface configured to hop onto and off of a fabric, and
  - a needle opening configured to allow a needle to reciprocate into and out of the fabric through the needle opening; and
- a presser bar shaft configured to couple to a presser bar of a maneuverable quilting machine, the presser bar shaft defining an outermost boundary, the presser bar shaft attached to the base such that the outermost boundary of the presser bar shaft is positioned to the right of the left straight edge and to the left of the right straight edge.

2. The hopping foot of claim 1, wherein:
- the front straight edge is perpendicular to the left straight edge and the right straight edge;
- the base further defines a rear straight edge; and
- the rear straight edge is perpendicular to the left straight edge and the right straight edge.

3. The hopping foot of claim 2, wherein:
- the left straight edge is spaced apart from the right straight edge by about 0.50 inches and the front straight edge is spaced apart from the rear straight edge by about 0.50 inches; or
- the left straight edge is spaced apart from the right straight edge by about 1.00 inches and the front straight edge is spaced apart from the rear straight edge by about 1.00 inches.

4. The hopping foot of claim 1, wherein the presser bar shaft is configured to couple to the presser bar via a portion of the presser bar being inserted into a cylindrical opening defined in the presser bar shaft.

5. The hopping foot of claim 1, wherein at least a portion of the base is formed from a transparent material.

6. The hopping foot of claim 1, wherein the presser bar shaft is attached to the base such that the presser bar shaft and the base are a single integral molded component formed from a transparent material.

7. A hopping foot for a maneuverable quilting machine, the hopping foot comprising:
- a base defining:
  - a left straight edge,
  - a right straight edge,
  - a front straight edge perpendicular to the left straight edge and the right straight edge,
  - a bottom surface configured to hop onto and off of a fabric, a portion of the bottom surface being a flat surface that spans from the left straight edge to the right straight edge, and
  - a needle opening configured to allow a needle to reciprocate into and out of the fabric through the needle opening; and
- a presser bar shaft configured to couple to a presser bar of a maneuverable quilting machine, the presser bar shaft defining an outermost boundary, the presser bar shaft attached to the base such that the outermost boundary of the presser bar shaft is positioned to the right of the left straight edge and to the left of the right straight edge.

8. The hopping foot of claim 7, wherein:

the base further defines a rear straight edge; and the rear straight edge is perpendicular to the left straight edge and the right straight edge.

9. The hopping foot of claim 8, wherein:

the left straight edge is spaced apart from the right straight edge by about 0.50 inches and the front straight edge is spaced apart from the rear straight edge by about 0.50 inches; or the left straight edge is spaced apart from the right straight edge by about 1.00 inches and the front straight edge is spaced apart from the rear straight edge by about 1.00 inches.

10. The hopping foot of claim 7, wherein the presser bar shaft is configured to couple to the presser bar via a portion of the presser bar being inserted into a cylindrical opening defined in the presser bar shaft.

11. The hopping foot of claim 7, wherein the presser bar shaft is attached to the base such that the presser bar shaft and the base are a single integral molded component formed from a transparent material.

12. A hopping foot for a maneuverable quilting machine, the hopping foot comprising:

a base defining:

a left straight edge, a right straight edge, a front straight edge perpendicular to the left straight edge and the right straight edge, a rear straight edge perpendicular to the left straight edge and the right straight edge, a bottom surface configured to hop onto and off of a fabric, and a needle opening configured to allow a needle to reciprocate into and out of the fabric through the needle opening; and a presser bar shaft configured to couple to a presser bar of a maneuverable quilting machine, the presser bar shaft defining an outermost boundary, the presser bar shaft attached to the base such that the outermost boundary of the presser bar shaft is positioned to the right of the left straight edge and to the left of the right straight edge, the presser bar shaft further attached to the base such that the presser bar shaft and the base are a single integral molded component, the presser bar shaft and the base formed from a transparent material.

13. The hopping foot of claim 12, wherein:

the left straight edge is spaced apart from the right straight edge by about 0.50 inches; and the front straight edge is spaced apart from the rear straight edge by about 0.50 inches.

14. The hopping foot of claim 12, wherein:

the left straight edge is spaced apart from the right straight edge by about 1.00 inches; and the front straight edge is spaced apart from the rear straight edge by about 1.00 inches.

15. A maneuverable quilting machine comprising:

the hopping foot of claim 12;

the presser bar to which the presser bar shaft of the hopping foot is configured to couple; and the needle that is configured to reciprocate into and out of the fabric through the needle opening defined in the base of the hopping foot.

16. The hopping foot of claim 1, wherein a portion of the bottom surface is a flat surface that spans from the left straight edge to the right straight edge.

17. The hopping foot of claim 3, wherein the center of the needle opening is positioned about half-way in between the left straight edge and the right straight edge and about half-way in between the front straight edge and the rear straight edge.

18. A maneuverable quilting machine comprising:

the hopping foot of claim 1;

the presser bar to which the presser bar shaft of the hopping foot is configured to couple; and the needle that is configured to reciprocate into and out of the fabric through the needle opening defined in the base of the hopping foot.

19. A maneuverable quilting machine comprising:

the hopping foot of claim 7;

the presser bar to which the presser bar shaft of the hopping foot is configured to couple; and the needle that is configured to reciprocate into and out of the fabric through the needle opening defined in the base of the hopping foot.

20. The hopping foot of claim 12, wherein a portion of the bottom surface is a flat surface that spans from the left straight edge to the right straight edge.

* * * * *